US006352408B1

(12) United States Patent
Kilian

(10) Patent No.: US 6,352,408 B1
(45) Date of Patent: Mar. 5, 2002

(54) SLIP INHIBITING BOAT PROPELLER

(75) Inventor: Robert B. Kilian, 2507 Outrigger, San Leandro, CA (US) 94577

(73) Assignee: Robert B. Kilian, San Lorenzo, CA (US)

( * ) Notice: Subject to any disclaimer, the term of this patent is extended or adjusted under 35 U.S.C. 154(b) by 0 days.

(21) Appl. No.: 09/687,103

(22) Filed: Oct. 16, 2000

(51) Int. Cl.[7] ..... F04D 29/38

(52) U.S. Cl. ..... 416/191; 416/237; 416/235; 416/236 A; 416/192

(58) Field of Search ..... 416/191, 192, 416/238, 235, 237, 245 A, 244 B, 236 A, 236 R

(56) References Cited

U.S. PATENT DOCUMENTS

| | | | | | |
|---|---|---|---|---|---|
| 33,077 | A | * | 8/1861 | Elliott | 416/237 |
| 698,582 | A | * | 4/1902 | Strothman | 416/237 |
| 1,041,912 | A | * | 10/1912 | Tyson | 416/237 |
| 1,041,913 | A | * | 10/1912 | Tyson | 416/237 |
| 1,110,979 | A | | 9/1914 | Agan | |
| 1,117,103 | A | | 11/1914 | Steinbach | |
| 1,597,175 | A | | 8/1926 | Boening | |
| 2,086,307 | A | * | 7/1937 | Stewart | 416/237 |
| 2,978,040 | A | | 4/1961 | Wirkkala | |
| 3,782,857 | A | * | 1/1974 | Svilans | 416/235 |
| 4,632,636 | A | | 12/1986 | Smith | |

FOREIGN PATENT DOCUMENTS

| | | |
|---|---|---|
| AU | 115848 | 9/1942 |

* cited by examiner

*Primary Examiner*—Christopher Verdier
*Assistant Examiner*—Richard Woo
(74) *Attorney, Agent, or Firm*—Harris Zimmerman, Esq.

(57) ABSTRACT

Efficiency of a boat propeller is increased by curved flanges extending along the tips of the propeller blades. The flanges form projections at the blade tips which deflect water that flows radially towards the tips outward into the thrust producing water flow through the propeller. The flanges have arcuate outer surfaces that face away from the propeller hub and which have a center of curvature at the axis of rotation of the propeller. Arcuate inner surfaces of the flanges have centers of curvature which are offset from the axis of rotation. This flange configuration inhibits cavitation in the region of the flanges and also at the hub region of the propeller.

10 Claims, 4 Drawing Sheets

FIG. 3
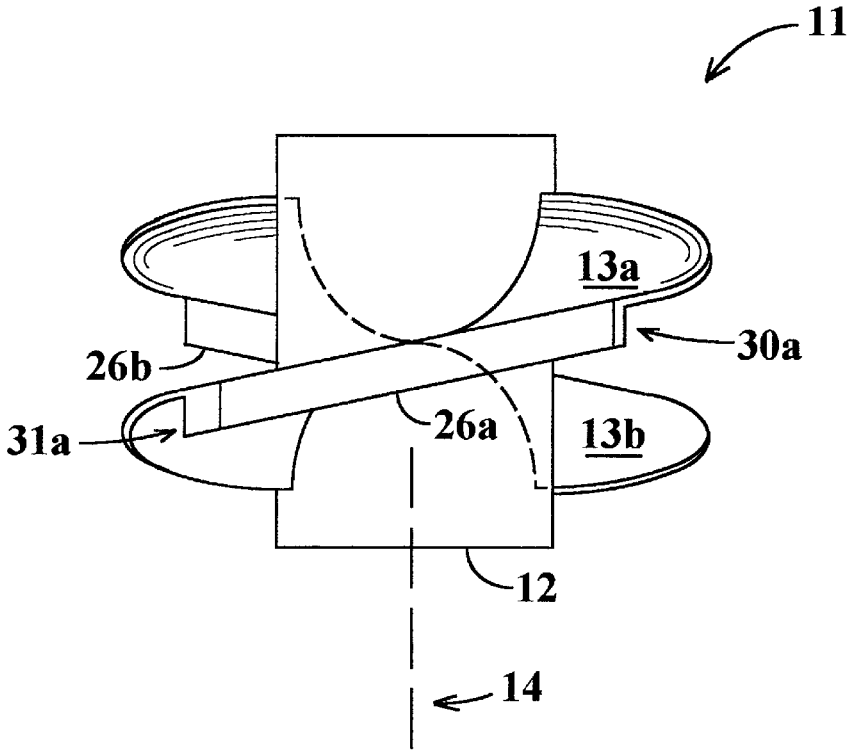
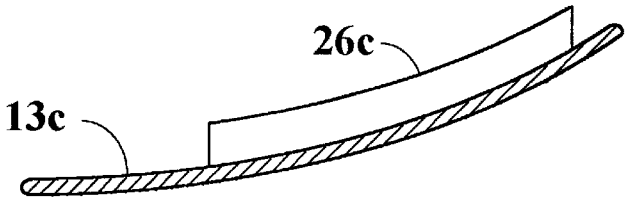
FIG. 5

SLIP INHIBITING BOAT PROPELLER

TECHNICAL FIELD

This invention relates to propulsion apparatus for boats and more particularly to bladed propellers which revolve under water to exert thrust on the hull of a boat.

BACKGROUND OF THE INVENTION

Revolving propellers generate a thrust force on the hull of a boat by forcing a water flow outward from the back of the propeller. The water flow produced by a bladed propeller of conventional design also moves radially relative to the rotary axis of the propeller which effect is most pronounced in the tip region of the blades. The radially directed component or slip of the water flow does not produce forward thrust. This reduces the efficiency of the propeller and unproductively consumes a portion of the power produced by the engine which drives the propeller. The radial slip flow may also reduce water pressure at the back of the propeller thereby further reducing propeller efficiency.

Non-slip propellers have heretofore been designed for the purpose of redirecting radial water flow at the backs of the propeller blades in a manner which causes it to flow in a more horizontal direction. The horizontal flow adds to the thrust produced by the propeller and thereby increases efficiency. Non-slip propellers of this kind have a flange or lip at the outer end of each blade which extends outward along the tip of the blade in position to intercept the radial flow and to redirect it into a horizontal flow. The trailing edge of the flange is typically closer to the rotary axis of the propeller than the leading edge of the flange. This increases water pressure at the backs of the blades and thereby further increases efficiency.

The high efficiency of the non-slip propeller enables use of smaller diameter propellers in instances where that is desirable such as in shallow draft boats. Pre-existing propellers of traditional design can be reduced in size without loss of efficiency by machining them to have a smaller diameter and then adding the slip redirecting flanges to the tips of the blades. Non-slip propellers can also reduce or virtually eliminate noise problems which are sometimes caused by propellers throwing water against the hulls of boats.

Prior non-slip propellers of the above discussed type have not fully realized the gains in efficiency which are potentially possible. In some designs the non-slip flange has an outer surface, facing away from the rotary axis of the propeller, that is curved or angled to extend closer to the rotary axis at its trailing end than at its leading end. Cavitation can cause a water pressure reduction along the outer surface of the flange that increases resistance to rotation of the propeller. Overcoming this increased resistance consumes power produced by the engine which drives the propeller. In other prior designs the non-slip flanges have centers of curvature which are at the rotary axis of the propeller so that the leading ends and trailing ends of the flanges are equidistant from the rotary axis. This flange configuration is not subject to the cavitation effect discussed above but it does not increase water pressure at the back of the propeller in a manner which optimizes efficiency.

The present invention is directed to overcoming one or more of the problems discussed above.

SUMMARY OF THE INVENTION

In one aspect the present invention provides a boat propeller having a revolvable hub centered on an axis of rotation and having a plurality of blades extending outward from the hub at equiangular intervals therearound. The blades are pitched to create a thrust producing flow of water through the propeller. Each blade has a curved flange extending along a tip region of the blade and extending outward from the tip region of the blade in position to deflect water which travels towards the tip region outward into the thrust producing water flow. Each flange has an arcuate outer surface which faces away from the axis of rotation and which has a center of curvature situated at the axis of rotation. Each flange has an arcuate inner surface which faces the axis of rotation and which has a center of curvature that is offset from the axis of rotation in a direction which causes the distance between a trailing end of the flange and the axis of rotation to be smaller than the distance between a leading end of the flange and the axis of rotation.

In another aspect the invention provides a boat propeller having an annular revolvable hub centered on an axis of rotation of the propeller. A plurality of blades extend radially from the hub, the blades being situated at equiangular intervals around the axis of rotation and being pitched to create a thrust producing flow of water through said propeller as the propeller turns. Each blade has a curved flange portion extending along the tip of the blade at the outmost region of the blade and extending outward from the tip of the blade in position to deflect slip flow water which travels towards the tip outward into the thrust producing flow of water. Each of the flange portions has an arcuate outer surface which faces away from the hub and which has a center of curvature situated at the axis of rotation. Each flange portion has an arcuate inner surface which faces the hub and which has an offset center of curvature that is offset from the axis of rotation in a direction which causes successive regions of the arcuate inner surface of the flange portion to be progressively closer to the hub.

The invention provides a highly efficient boat propeller of the type which has non-slip flanges at the tips of the propeller blades to convert non-productive radially directed water flow into a more horizontal flow which creates thrust. The outer surface of each flange which faces away from the direction of movement of the flange has a center of curvature which is at the rotary axis of the propeller. This avoids power wasting cavitation effects in the water adjacent to that surface. The inner surface of each flange which faces towards the direction of travel of the flange has a center of curvature which is offset from the rotary axis of the propeller to cause the trailing end of the inner surface to be closer to the center of the propeller than the leading end of the flange. Consequently, the flanges exert pressure against adjacent water which pressure is exerted in the direction of the hub of the propeller. This increases water pressure at the aft face of the hub region of the propeller and thereby inhibits cavitation at that region.

The invention, together with further aspects and advantages thereof, may be further understood by reference to the following description of the preferred embodiments and by reference to the accompanying drawings.

BRIEF DESCRIPTION OF THE DRAWINGS

FIG. 3 is a top view of the boat propeller of the preceding figures.

FIG. 5 is a cross section view taken along line 5—5 of FIG. 4.

DETAILED DESCRIPTION OF THE PREFERRED EMBODIMENTS

Boat propellers are made in various sizes and may have different numbers of blades and different blade configurations depending on the type of watercraft with which the propeller is designed to be used. It should be recognized that the present invention is not limited to use in propellers having the specific designs which are herein described for purposes of example.

Figure 1:
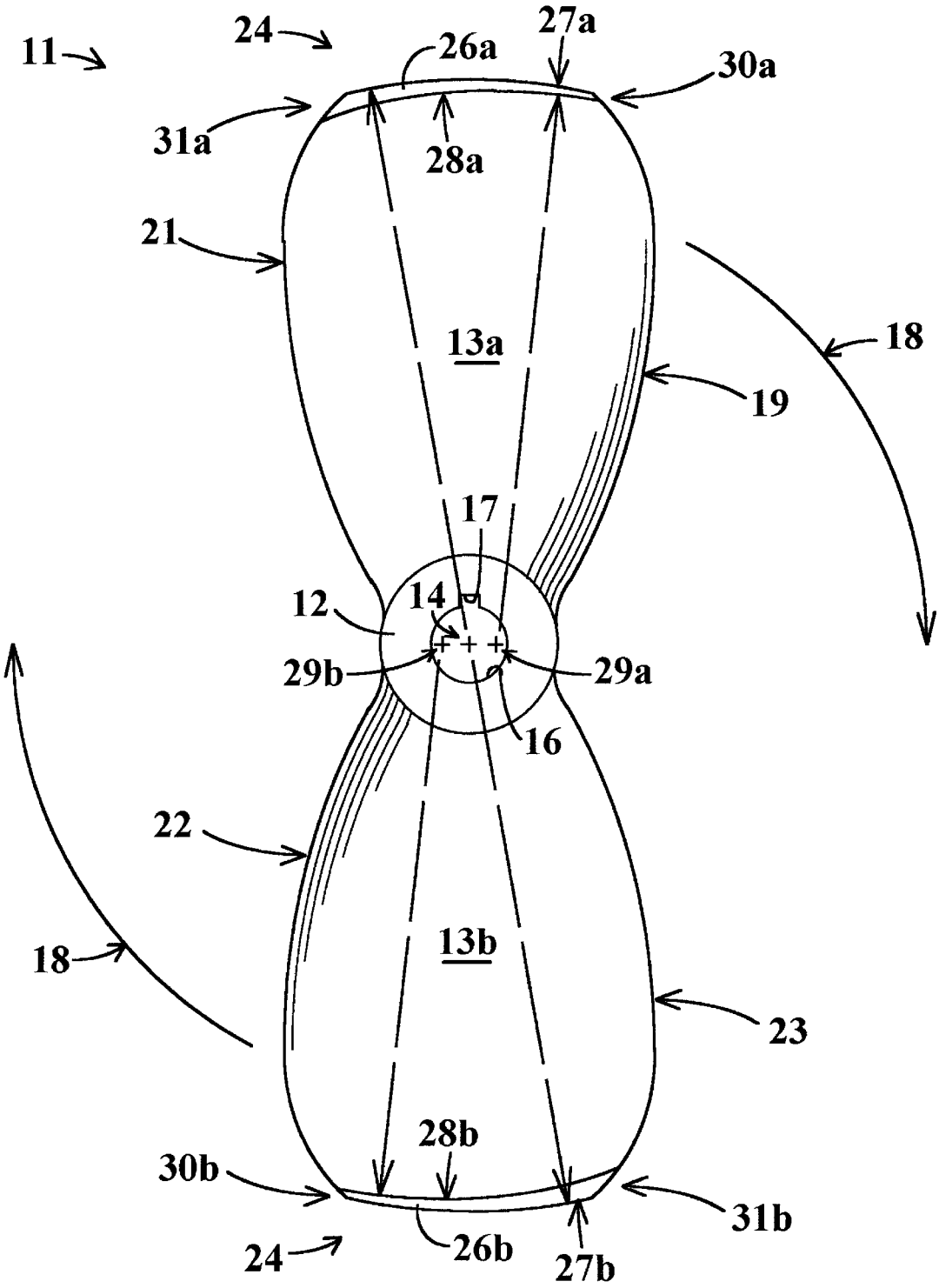
FIG. 1 is an elevation view of the back or aft face of a boat propeller in accordance with a first embodiment of the invention.
Figure 2:
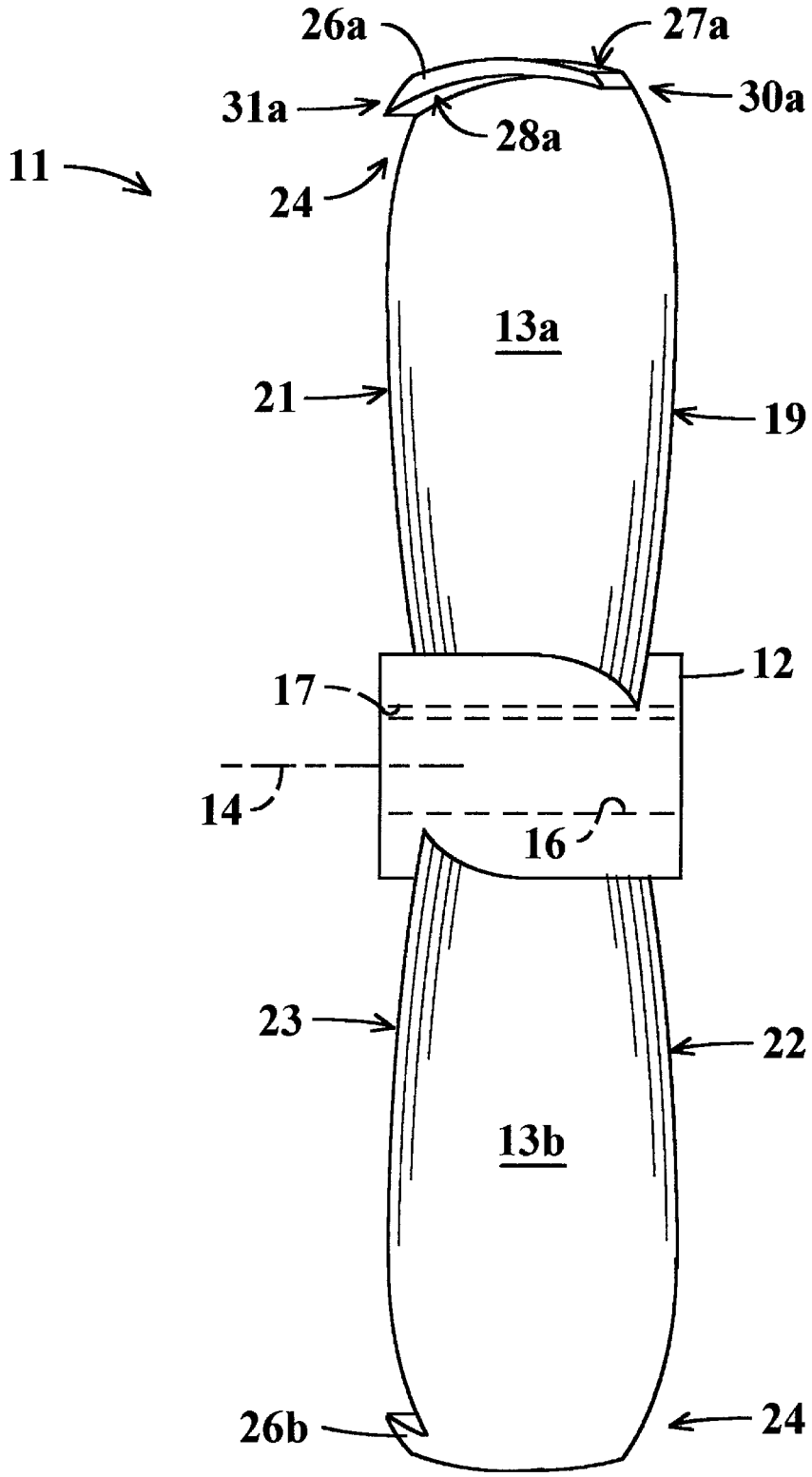
FIG. 2 is a side elevation view of the boat propeller of FIG. 1 as it appears when viewed from the right side of the propeller.

Referring jointly to FIGS. 1, 2 and 3 of the drawings, the boat propeller 11 of this example has a cylindrical hub 12 and two blades 13*a* and 13*b* which extend radially from the hub in opposite directions. The blades 13*a* and 13*b* are pitched or angled relative to the axis of rotation 14 of the propeller 11 to cause an outward flow of water from the back of the propeller when it is revolved. The angling or pitch of the blades 13*a* and 13*b* may be varied in the known manner depending on the type of boat for which the propeller 11 is designed.

Hub 12 has an axially directed bore 16 and a key slot 17 extending along the wall of the bore for enabling mounting of the propeller 11 on the motor driven propeller shaft (not shown) of a boat in the known manner.

The propeller 11 of this particular example turns in a clockwise direction as viewed in FIG. 1 as indicated by arrows 18 in the drawing. Thus edge 19 of blade 13*a* is a leading edge with respect to the revolving motion of the blade and edge 21 is a trailing edge. Edge 22 of the other blade 13*b* is the leading edge of that blade and edge 23 is the trailing edge.

In the absence of further structural features which will be hereinafter described, a sizable portion of the water flow produced by the propeller 11 would flow outward from the tip regions 24 of the blades 13*a* and 13*b* in radial directions relative to the axis of rotation 14 of the propeller. Radial flow, known as slip, does not generate thrust for producing forward motion of the boat. Radial or slip flow decreases the efficiency of a propeller and wastes power produced by the driving engine.

In the present invention radial flow off the tip regions 24 of the blades is intercepted and converted to a thrust producing backward flow from the propeller 11 by arcuate flanges 26*a* and 26*b* which extend along the tip regions of blades 13*a* and 13*b*, respectively. Referring again to FIGS. 1, 2 and 3 in conjunction, flanges 26*a* and 26*b* are lips which project a short distance outward in a horizontal direction from the radially directed portions of the blades 13*a*, 13*b* at the back face of the propeller 11. Gains in efficiency are optimized if the flanges 26*a* and 26*b* extend from the leading edges 19 and 22 of the blades 13*a*, 13*b* to the trailing edges 21 and 23 and are at the radially outermost portions of the blades 13*a* and 13*b*.

Arcuate outer surfaces 27*a* and 27*b* of flanges 26*a* and 26*b* face away from the axis of rotation 14 of propeller 11 and have a center of curvature which is at the axis of rotation. Arcuate inner surfaces 28*a* and 28*b* of flanges 26*a* and 26*b*, which face towards the axis of rotation 14, have different centers of curvature 29*a* and 29*b*, respectively. Centers of curvature 29*a* and 29*b* are off-set in different directions from the axis of rotation 14 while being equidistant-distant from the axis of rotation. Center of curvature 29*a* is located to cause the distance between the trailing end 31*a* of inner surface 28*a* and the axis of rotation 14 to be smaller than the distance between the leading end 30*a* of that inner surface and the axis of rotation. Center of curvature 29*b* is located to cause the distance between the trailing end 31*b* of inner surface 28*b* and the axis of rotation 14 to be smaller than the distance between the leading end 30*b* of that inner surface and the axis of rotation.

These offsets of centers of curvature 29*a* and 29*b* cause the inner surfaces 28*a* and 28*b* of flanges 26*a* and 26*b* to curve inward towards the axis of rotation 14. The curvature is such that the end of flange 26*a* which is at the trailing edge 21 of blade 13*a* is thicker than the end of the flange which is at leading edge 19, there being a progressive increase in the thickness of the flange between the leading edge and the trailing edge of the blade. Similarly, the end of the other flange 26*b* that is at the trailing edge 23 of the other blade 13*b* is thicker at the trailing edge 23 of that blade than it is at the leading edge 22 of that blade.

Cavitation at the back of the hub region of boat propellers creates a suction like effect which acts against and reduces the forward thrust produced by the propeller. In the propeller 11 of this invention, the inward curvatures of inner surfaces 28*a* and 28*b* of flanges 26*a* and 26*b* causes the flanges to exert pressure against adjacent water in the direction of the hub 12 region of the propeller 11. This increases water pressure in back of the hub 12 region and thereby reduces the adverse effects of cavitation. As the outer surfaces 27*a* and 27*b* of flanges 26*a* and 26*b* do not curve inward towards the axis of rotation 14, cavitation does not occur along those surfaces which cavitation would resist turning of the propeller and thereby waste engine power.

Figure 4:
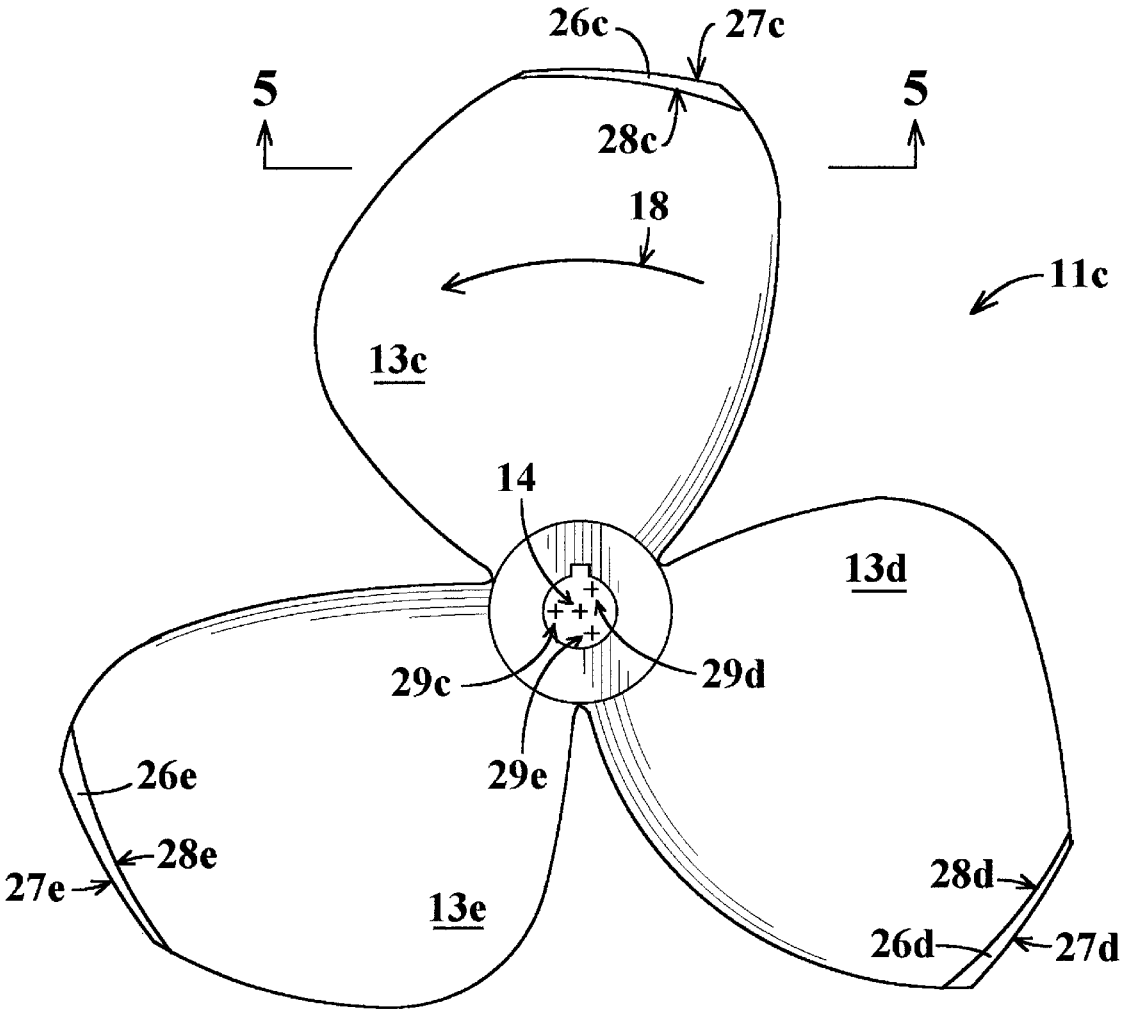
FIG. 4 is an elevation view of the back or aft face of a boat propeller in accordance with a second embodiment of the invention.

FIGS. 4 and 5 depict another example of the invention as applied to a boat propeller 11*c* of the type having three blades 13*c*, 13*d* and 13*e*. As in the previously described embodiment, arcuate flanges 26*c*, 26*d* and 26*e* extend along the tips of the blades 13*c*, 13*d* and 13*e* and project outward from the blades in the aft direction. Outer surfaces 27*c*, 27*d* and 27*e* of the flanges, which face away from the axis of rotation 14 of the propeller, have a center of curvature which is situated at the axis of rotation. Inner surfaces 28*c*, 28*d* and 28*e* of the flanges 26*c*, 26*d* and 26*e* respectively, which face towards the axis of rotation 14, have centers of curvature 29*c*, 29*d* and 29*e* respectively which are offset from axis of rotation 14 in the previously described manner. In particular, the centers of curvature 29*c*, 29*d* and 29*e* of the inner surfaces 28*c*, 28*d* and 28*e* are located to cause the trailing ends of the inner surfaces to be closer to axis of rotation 14 than the leading ends of the inner surfaces.

Flanges 26*c*, 26*d* and 26*e* of this configuration increase propeller efficiency in the manner previously described with reference to the first embodiment of the invention. Radially directed slip flow of water is deflected outwardly and then contributes to the forward thrust produced by the propeller. The inwardly curving inner surfaces 28*c*, 28*d* and 28*e* of flanges 26*c*, 26*d* and 26*e* inhibit cavitation at the hub region of the back of the propeller 11*c* by increasing water pressure at that region. Cavitation does not occur along the outer surfaces 27*c*, 27*d* and 27*e* of the flanges 26*c*, 26*d* and 26*e* as those surfaces do not curve inward towards axis of rotation 14.

The above described flange configuration is advantageous when employed in newly manufactured propellers and is also highly useful for reconfiguring pre-existing propellers which originally lack flanges of the above described kind.

The extreme tip region of the blades of the originally unflanged propeller can be cut away and flanges of the above described kind can then be added. In some cases the metal which has been cut away can be melted and used to form the flanges. Reconfiguring of a pre-existing propeller in this manner enables the diameter of the propeller to be reduced without a reduction in the amount of thrust that is produced by the propeller. Reduction of propeller diameter can be desirable for a variety of reasons, most notably where the propeller is used on a shallow draft boat.

While the invention has been described with reference to certain specific embodiments for purposes of example, many modifications and variation are possible and it is not intended to limit the invention except as defined in the following claims.

What is claimed is:

1. A boat propeller having a revolvable hub centered on an axis of rotation and a plurality of blades extending outward from the hub at equiangular intervals therearound, each of said blades having a leading edge and a trailing edge and being pitched to create a thrust producing flow of water through the propeller, further comprising:

each of said blades having a curved flange extending along a tip region of the blade and extending outward from the tip region of the blade in position to deflect water which travels towards said tip region outward into said thrust producing water flow, each of said flanges having an arcuate outer surface which faces away from said axis of rotation and which has a center of curvature situated at said axis of rotation, each of said flanges having an arcuate inner surface which faces said axis of rotation and which has a center of curvature that is offset from said axis of rotation in a direction which causes the distance between a trailing end of the flange and said axis of rotation to be smaller than the distance between a leading end of the flange and said axis of rotation.

2. The boat propeller of claim 1 wherein said flange of each of said blades extends from said leading edge of the blade to said trailing edge thereof.

3. The boat propeller of claim 2 wherein said leading edge and trailing edge of each blade curve towards each other in the tip region of the blade and wherein said leading end and trailing end of each of said flanges have curvatures conforming to the curvatures of said leading edge and trailing edge of the blade in that region.

4. The boat propeller of claim 1 wherein said arcuate outer surfaces of said flanges form radially outermost surfaces of said blades.

5. The boat propeller of claim 1 wherein successive portions of said arcuate outer surface of each flange are equidistant from said axis of rotation.

6. The boat propeller of claim 1 wherein said arcuate inner surfaces of said flanges extend outward from said blades in a direction which is substantially parallel to said axis of rotation.

7. The boat propeller of claim 1 wherein said offset centers of curvature of said arcuate inner surfaces of said flanges are situated in single plane which extends at right angles to said axis of rotation and are equidistant from said axis of rotation.

8. The boat propeller of claim 1 wherein said flange of each of said blades extends substantially from said leading edge of the blade to said trailing edge thereof, wherein said arcuate outer surfaces of said flanges form radially outermost surfaces of said propeller, wherein said arcuate inner surfaces of said flanges extend outward from said blades in a direction which is substantially parallel to said axis of rotation, and wherein said offset centers of curvature of said arcuate inner surfaces of said flanges are situated in single plane which extends at right angles to said axis of rotation and are equidistant from said axis of rotation.

9. A boat propeller comprising:

an annular revolvable hub centered on an axis of rotation of said propeller, a plurality of blades extending radially from said hub and having tips which form radially outermost portions of said blades, said blades being situated at equiangular intervals around said axis of rotation and being pitched to create a thrust producing flow of water through said propeller as the propeller turns, each of blades having a curved flange portion extending along the tip of the blade and extending outward from the tip of the blade in position to deflect slip flow water which travels towards said tip outward into said thrust producing flow of water, each of said flange portions having an arcuate outer surface which faces away from said hub and which has a center of curvature situated at said axis of rotation, each of said flange portions having an arcuate inner surface which faces said hub and which has an offset center of curvature that is offset from said axis of rotation in a direction which causes successive regions of said arcuate inner surface to be progressively closer to said hub.

10. The boat propeller of claim 9 wherein each of said blades has a leading edge and a trailing edge and wherein said flange portion of the blade extends from the leading edge of the blade to the trailing edge thereof and is the radially outermost portion of the blade.

* * * * *